US005481068A

United States Patent [19]

Norden

[11] Patent Number: 5,481,068

[45] Date of Patent: Jan. 2, 1996

[54] ELECTRICAL CABLE

[75] Inventor: Stanley M. Norden, Swindon, England

[73] Assignee: Raychem Limited, Swindon, England

[21] Appl. No.: 368,255

[22] Filed: Jan. 3, 1995

Related U.S. Application Data

[63] Continuation of Ser. No. 74,835, Jun. 11, 1993, abandoned.

[30] Foreign Application Priority Data

Dec. 13, 1990 [GB] United Kingdom ..... 9027110

[51] Int. Cl.[6] ..... H01B 7/34

[52] U.S. Cl. ..... 174/36; 174/10; 174/102 R; 174/109

[58] Field of Search ..... 174/36, 10, 109, 174/102 R

[56] References Cited

U.S. PATENT DOCUMENTS

| | | | |
|---|---|---|---|
| 1,969,764 | 8/1934 | Soutter, Jr. | 174/10 |
| 2,924,141 | 2/1960 | Kinniburgh | 174/36 |
| 4,038,489 | 7/1977 | Stenson et al. | 174/10 |
| 4,041,237 | 8/1977 | Stine et al. | 174/36 |
| 4,096,346 | 6/1978 | Stine et al. | 174/36 |
| 4,510,346 | 4/1985 | Bursh, Jr. et al. | 174/36 |
| 5,118,905 | 6/1992 | Harada | 174/109 |
| 5,254,188 | 10/1993 | Blew | 174/36 X |

FOREIGN PATENT DOCUMENTS

| | | | |
|---|---|---|---|
| 0198310 | 10/1986 | European Pat. Off. . | |
| 1404549 | 12/1965 | France . | |
| 2519797 | 7/1983 | France . | |
| 9003135 | 6/1990 | Germany . | |
| 3917088 | 8/1990 | Germany . | |
| 457578 | 12/1936 | United Kingdom | 174/10 |
| 1387065 | 3/1975 | United Kingdom . | |
| 420885 | 3/1993 | United Kingdom | 174/10 |

*Primary Examiner*—Morris H. Nimmo
*Attorney, Agent, or Firm*—Sheri M. Novack; Herbert G. Burkard

[57] ABSTRACT

An electrical cable comprises one or more insulated elongate electrical conductors (1,2), a metal electrical shield 5 surrounding the conductors and a pull-thread 7 that extends along the cable under the shield so that the shield can be cut longitudinally by pulling the thread.

The cable can be stripped of shield and jacket simply by pulling the thread and then tearing the end of the shield and jacket off. If desired a second conventional pull thread may be located between the shield and jacket in order to allow the jacket to be removed and the shield exposed.

8 Claims, 1 Drawing Sheet

ELECTRICAL CABLE

This application is a continuation of application Ser. No. 08/074,835, filed Jun. 11, 1993 now abandoned.

This invention relates to electrical cables, in particular to cables that are provided with a screen, for example to prevent or reduce electromagnetic interference.

Commonly employed screened cables include coaxial cables in which a single elongate electrical conductor is surrounded by a dielectric and a conductive screen. Other screened cables employ one or more insulated conductors, eg. in twisted pair configuration, the conductor or conductors being enclosed in a single common screen.

Where screened cables are used it is often necessary to cut the screen back in order to expose a length of the underlying insulated conductor(s), for example so that the conductors can be terminated, eg. in an electrical connector or in a black box with appropriate termination of the screen. The conventional method of terminating a cable with a braided screen comprises (i) forming a nick or slit in the jacket by means of a knife and pulling off the jacket, and (ii) pushing the exposed end of the braid axially toward the rest of the braid to cause it to bulge radially and then cutting the braid at the appropriate point with a pair of snips.

This operation has the serious disadvantage that it requires the use of a knife. The use of knives in cable termination and harness formation is discouraged, and in many harness shops knives are not permitted in view of the danger of unintentionally damaging the wire or cable insulation of parts of the harness not being worked upon. In addition, in some cases it is difficult to cause the braid to bulge radially by pushing it axially. For example in one form of shielded cable the cable shield is formed from monofilaments having a substantially flat cross-section in order to reduce the cable profile and to reduce the weight of the cable, and this form of cable shield is very difficult or impossible to expand radially by pushing it axially.

According to the present invention there is provided an electrical cable which comprises one or more elongate electrical conductors, a layer of insulation surrounding the or each electrical conductor, and a metal electrical shield surrounding the conductor or conductors and the insulation, the cable including a pull-thread that extends along the length of the cable under the shield so that the shield can be cut longitudinally by pulling the thread.

We have found that it is possible to cut through a cable shield formed for example from a metal braid by pulling the pull-thread or stripping thread along the cable without undue expenditure of effort. Indeed the effort needed to cut through a braid and cable jacket may not in some instances be substantially greater than that needed to cut through the cable jacket alone even though the thread is being employed to cut through a significant thickness of metal. While it is not always necessary for the cable to include a cable jacket, this is preferred since the cable jacket will hinder or prevent movement of the braid filaments when the braid is cut by the thread. Preferred jacket materials include polymers such as Polyolefins, eg. ethylene homopolymers and copolymers with alpha olefins, halogenated polymers, eg. tetrafluorethylene, vinylidene fluoride, hexafluoropropylene and vinyl chloride homo or copolymers, especially ethylene/tetrafluoroethylene copolymer, polamides, polyesters, polyimides, polyether ketones, eg. polyarylether ketones, aromatic polyether imides and sulphones, silicones, alkene/vinyl acetate copolymers and the like. The polymers may be used alone or as blends with one another and may contain fillers, eg. silica and metal oxides, eg. treated and untreated metal oxide flame retardants such as hydrated alumina and titania.

While the present invention is applicable to cables having only a single central conductor surrounded by a dielectric such as coaxial cables and single screened wires, it will more usually be applied to screened muliticonductor cables, eg. a screened twisted pair cables. It has hitherto been relatively difficult to cut back the screen of such cables in the case of flat filament braids, not only because it is difficult or impossible to cause the shield to bulge by pushing it toward the remainder of the shield but also because of the undulating surface of the cable caused by the helical geometry of the insulated conductors or wires. In the case of multiconductor cables it is possible for the pull thread to be layed up in the cable in the manner of an additional wire so that when it is pulled it will cut through the shield and jacket in a helical path. This may not be particularly easy or convenient for an operator to perform manually, and so it is preferred for the pull thread to extend substantially axially along the cable in order that it may be pulled along the cable at a substantially uniform orientation.

In principle the invention may be employed with cables having a variety of screens although normally the screen will be in the form of a braid, and the invention is particularly suited to cables having braids formed from flat filaments. Such flat braids appear to be cut very easily by the thread and it is believed that this ease of cutting according to the present invention and the difficulty of stripping flat braided cables by the conventional method are, in fact, related: The braid filaments cannot easily slide over one another but tend to remain fixed when subjected to a force distorting the braid. In the conventional stripping method this prevents the braid being caused to bulge, and in the cable according to the invention this same tendency prevents any accommodation of the stress applied by the thread as it cuts through the filaments.

The pull thread is preferably electrically insulating and more preferably formed from a polymer. The most preferred material is based on an aromatic polyamide for example as sold by Akzo under the trademark "Kevlar". It will normally be in the form of a relatively large number of monofilaments.

The cable may be provided with more than one stripping thread. For example the cable may be provided with one thread under the shield and a second thread under the jacket but over the shield so that part of the shield can be exposed by stripping the jacket only.

A shielded cable in accordance with the present invention will now be described by way of example with reference to the accompanying drawings in which.

Figure 1:
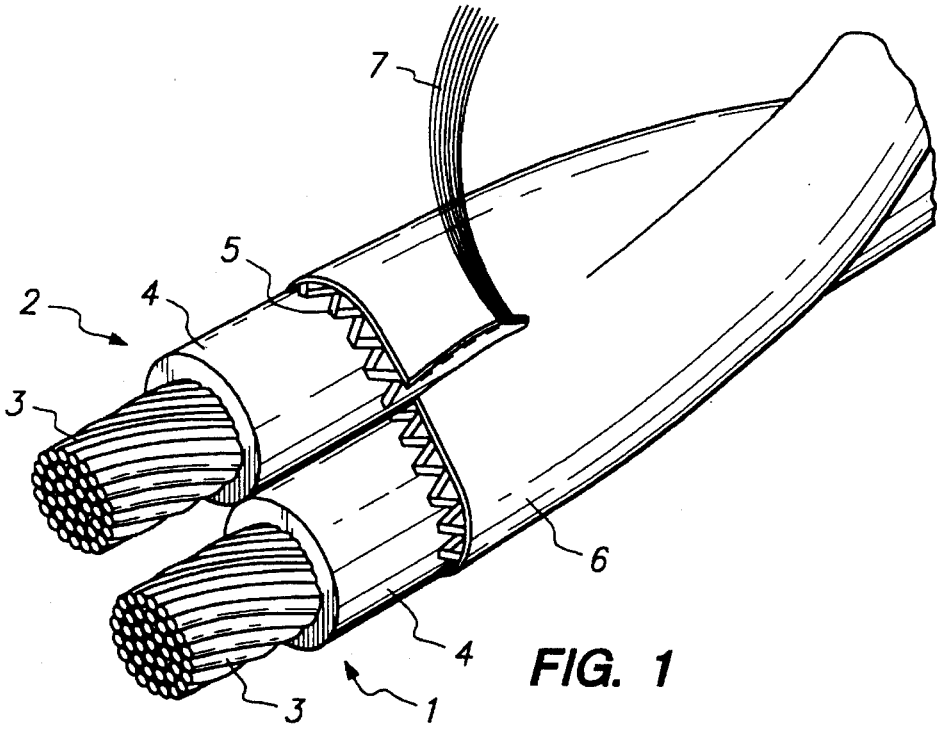
FIG. 1 is a perspective view of a shielded twisted pair cable.

Referring to the accompanying drawings a screened twisted pair cable comprises a twisted pair of wires 1 and 2 each comprising a stranded tinned copper conductor 3 and a single wall or dual wall insulation 4, formed for example from polyethylene and/or polyvinylidine fluoride.

A shield 5 is provided in the form of a braid of flattened tinned copper filaments followed by an extruded outer jacket 6 formed form an ethylene tetrafluoroethylene copolymer.

A pull thread 7 formed from a number of monofilaments of an aromatic polyamide (sold under the trademark "Kevlar") extends axially along the length of the cable underneath the cable jacket 6 and the shield 5.

In order to cut back the shield 5, the pull thread 7 is simply pulled perpendicularly to the cable causing it to cut through both the shield 5 and the jacket 6 until the shield and jacket have been severed to the appropriate length. The shield may then be terminated in any appropriate manner.

FIG. 2 shows a number of side views of a screened twisted pair cable at various stages during the termination process. The cable comprises a pair of insulated conductors 1 and 2 enclosed by a braided shield 5 and a jacket 6. The cable has two pull-threads, one thread 7 located under the shield 5 and the second thread 8 located under the jacket 6 but over the shield. The threads 7 and 8 will normally have different colours or patterns in order to distinguish them.

Figure 2A:
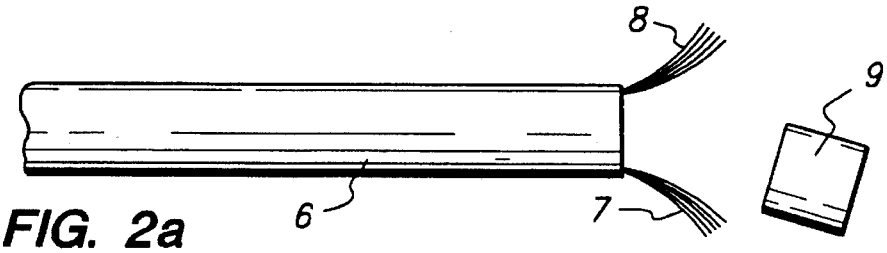
FIG. 2 is a schematic side view of a cable at a number of stages during the stripping process of the invention.
Figure 2B:
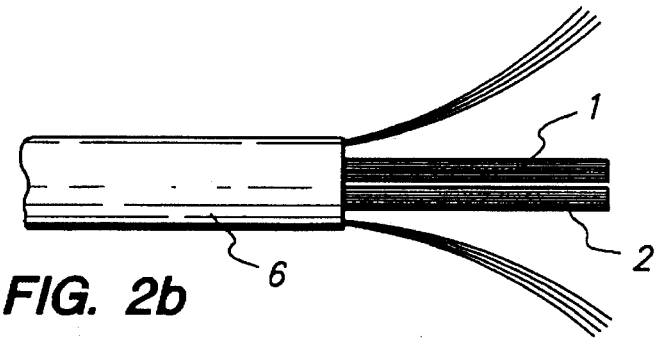
Figure 2C:
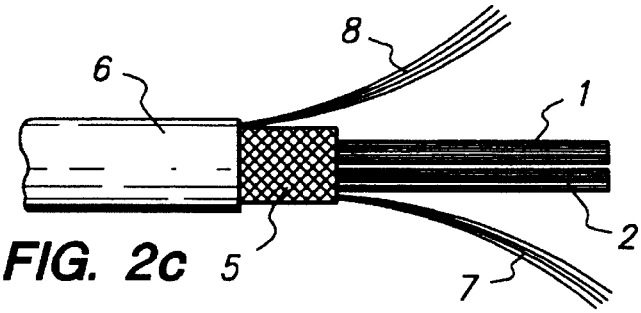

In order to strip the cable for termination a small length 9 of the cable, eg. a few centimeters, is cut off by means of a pair of snips. This operation will not normally sever the threads 7 and 8 due to their strength and so a short length of each thread will be exposed as shown in FIG. 2*a*. Thread 7 is then pulled in order to slit the jacket 6 and shield 5 to the point at which the shield 5 can be tidied up with a pair of snips to form the cable as shown in FIG. 2*b*. Then the thread 8 is pulled back in order to slit the jacket 6 by the amount it is desired to expose the shield 5. The end of the jacket 6 can be torn off circumferentially and tidied by means of snips to form the cable as shown in FIG. 2*c*. The excess lengths of pull-thread can be cut off at any convenient point.

I claim:

1. An electrical cable which comprises one or more elongate electrical conductors, a layer of insulation surrounding the or each electrical conductor, and a metal braid electrical shield surrounding the conductor or conductors and the insulation, the cable including a pull-thread that extends along the length of the cable under the shield so that the shield can be cut longitudinally by pulling the thread.

2. A cable as claimed in claim 1, wherein the braid is formed from flat filaments.

3. A cable as claimed in any one of claim 1, which includes a cable jacket located over the electrical shield.

4. A cable as claimed in any one of claim 1, which includes a plurality of insulated elongate conductors.

5. A cable as claimed in any one of claim 1, wherein the pull thread extends substantially axially along the cable.

6. A cable as claimed in any one of claim 1, wherein the pull thread is electrically insulating.

7. A cable as claimed in any one of claim 1, wherein the pull thread is formed from a polymer.

8. A cable as claimed in claim 7, wherein the pull thread is formed from an aromatic polyamide.

* * * * *

UNITED STATES PATENT AND TRADEMARK OFFICE

CERTIFICATE OF CORRECTION

PATENT NO. : 5,481,068

DATED : January 2, 1996

INVENTOR(S) : NORDEN

It is certified that error appears in the above-indentified patent and that said Letters Patent is hereby corrected as shown below:

Column 2, Line 39 replace "Akzo" by --E.I. duPont Nemours and Company--.

Signed and Sealed this

Seventh Day of May, 1996

Bruce Lehman

*Attest:*

BRUCE LEHMAN

*Attesting Officer*

*Commissioner of Patents and Trademarks*